US008301058B2

(12) United States Patent
Kim

(10) Patent No.: US 8,301,058 B2
(45) Date of Patent: Oct. 30, 2012

(54) DEVELOPING UNIT AND IMAGE FORMING APPARATUS HAVING THE SAME

(75) Inventor: Young Chae Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 168 days.

(21) Appl. No.: 12/839,484

(22) Filed: Jul. 20, 2010

(65) Prior Publication Data

US 2011/0069989 A1 Mar. 24, 2011

(30) Foreign Application Priority Data

Sep. 18, 2009 (KR) ..... 2009-88544

(51) Int. Cl.
*G03G 15/02* (2006.01)
*G03G 21/18* (2006.01)

(52) U.S. Cl. ..... 399/115; 399/100; 399/176

(58) Field of Classification Search ..... 399/115, 399/110, 174, 176, 100
See application file for complete search history.

(56) References Cited

U.S. PATENT DOCUMENTS

| | | | | |
|---|---|---|---|---|
| 5,465,136 | A * | 11/1995 | Watanabe | 399/115 X |
| 5,638,158 | A * | 6/1997 | Sanpe et al. | 399/174 |
| 5,873,019 | A * | 2/1999 | Mizuishi | 399/176 X |
| 6,665,507 | B1 * | 12/2003 | Hooper et al. | 399/110 |
| 2006/0251447 | A1 * | 11/2006 | Baek | 399/176 X |
| 2007/0230997 | A1 * | 10/2007 | Matsui | 399/115 X |
| 2007/0248382 | A1 * | 10/2007 | Oguma et al. | 399/176 X |

FOREIGN PATENT DOCUMENTS

JP 2003-076117 A * 3/2003

* cited by examiner

*Primary Examiner* — Sophia S Chen
(74) *Attorney, Agent, or Firm* — Stanzione & Kim, LLP

(57) ABSTRACT

A developing unit and an image forming apparatus having the same. The developing unit includes a controlling unit to restrict a contact position between the charging roller and a photosensitive body, thereby preventing deformation of the charging roller caused when the developing unit is not used for a long period of time.

22 Claims, 11 Drawing Sheets

DEVELOPING UNIT AND IMAGE FORMING APPARATUS HAVING THE SAME

CROSS-REFERENCE TO RELATED APPLICATIONS

This application claims priority under 35 USC §119 from Korean Patent Application No. 2009-0088544, filed on Sep. 18, 2009 in the Korean Intellectual Property Office, the disclosure of which is incorporated herein by reference.

BACKGROUND

1. Field of the General Inventive Concept

Embodiments of the present general inventive concept relate to a developing unit to reduce image faults.

2. Description of the Related Art

Generally, image forming apparatuses are devised to form an image on a printing medium according to inputted image signals. Examples of image forming apparatuses include printers, copiers, facsimiles, and so-called multi-functional devices that combine some of the functionalities of the aforementioned devices.

An image forming apparatus includes a developing unit in which developer is supplied to a photosensitive drum on which an electrostatic latent image has been formed, developing the electrostatic latent image into a visible image.

The developing unit is divided into a developer supply part in which developer is stored and a developing part in which an electrostatic latent image is developed into a visible image using the developer supplied from the developer supply part.

The developer supply part and the developing part of the developing unit may be integrated with each other, or may be separately prepared and detachably coupled to each other.

The developing unit conventionally takes the form of a cartridge, so that main constituent elements required to develop an image, such as a photosensitive drum, charging roller, cleaning roller, developing roller, supply roller, etc., are arranged within a body in the form of a single process cartridge.

In the case of the cartridge-shaped developing unit, nips are conventionally defined between the photosensitive drum and the charging roller and between the charging roller and the cleaning roller during a storage term prior to mounting the developing unit in the image forming apparatus.

More specifically, since the charging roller is compressed by a pressure member to come into press contact with the photosensitive drum, a nip having a predetermined depth is indented in a surface of the charging roller.

SUMMARY

Therefore, it is a feature of the present general inventive concept to provide a developing unit to prevent surface deformation of a roller provided therein.

Additional features of the general inventive concept will be set forth in part in the description which follows and, in part, will be obvious from the description, or may be learned by practice of embodiments of the present general inventive concept.

In accordance with one feature of the present general inventive concept, a developing unit includes a housing, a photosensitive body arranged in the housing, a roller arranged in the housing to come into contact with the photosensitive body, and a controlling unit installed in the housing to keep the roller at a first position spaced apart from the photosensitive body and then, when predetermined external force is applied to the controlling unit, to move the roller to a second position to allow the roller to come into contact with the photosensitive body.

The roller may include a charging roller to electrically charge the photosensitive body, a controlling member on which the charging roller is seated and supported, and an elastic member to elastically support and push the controlling member toward the photosensitive body.

The controlling unit may be coupled to a supporting member that may be attachable to and/or detachable from the housing.

The housing may include a controlling member mount to receive the controlling member, and the controlling member is slidable in the controlling member mount while supporting both ends of the charging roller.

The housing may include a first fixing portion to restrict movement of the controlling member that the charging roller may be spaced apart from the photosensitive body.

The controlling member may include a first holder configured to be releasably caught by the first fixing portion.

The first holder may be elastically deformable, so as to be released from the first fixing portion.

The first holder may include elastic rods extending opposite each other from one side of the controlling member so as to be elastically deformable, and holding protrusions formed at the elastic rods so as to be caught and supported by the first fixing portion.

The developing unit may further include a stopper member detachable between the first fixing portion and the first holder to allow the first holder to be releasably caught by the first fixing portion.

The first fixing portion may include a clamp member by which the first holder is releasably caught.

The first holder may include a holding protrusion formed at one side of the controlling member, and the clamp member may be rotatable about a rotating shaft and may have a supporting portion by which the holding protrusion is caught and supported.

The housing may include a second fixing portion to restrict movement of the controlling member so as to restrict a contact position between the charging roller and the photosensitive body when the controlling member is moved.

The controlling member may include a second holder configured to be caught and supported by the second fixing portion.

A cleaning roller to clean the charging roller may be rotatably coupled to the controlling member.

The developing unit may further include a cleaning roller spaced apart from the photosensitive body within the housing, and the cleaning roller may be positioned to come into contact with the charging roller when the charging roller comes into contact with the photosensitive body.

One side of the controlling member mount may communicate with the interior of the housing and the other side of the controlling member may communicate with the exterior of the housing.

The controlling member mount may include a first fixing portion to keep the charging roller spaced apart from the photosensitive body and a second fixing portion to restrict a contact position between the charging roller and the photosensitive body.

The controlling member may include a first holder configured to be releasably caught by the first fixing portion and a second holder configured to be releasably caught by the second fixing portion.

The first holder may include an elastic rod partially protruding through an opening that communicates with the exterior of the housing, so as to be released from the first fixing portion via elastic deformation thereof. The elastic rod may have a holding protrusion supported by the first fixing portion.

The elastic rod protruding through the opening may be pressed and deformed by a rod release unit provided at the body when the developing unit is mounted in the body.

In accordance with another feature of the present general inventive concept, in an image forming apparatus having a developing unit detachably installed in a body to form an image on a printing medium supplied via a paper supply unit, the developing unit includes a housing and a photosensitive body arranged in the body and adapted to be electrically charged by a charging roller, and the housing receives a controlling unit to restrict contact between the charging roller and the photosensitive body.

The controlling unit may include a controlling member on which the charging roller is seated and supported and an elastic member to elastically support and push the controlling member toward the photosensitive body, and the housing may include a controlling member mount in which the controlling member is movably installed. The controlling member mount includes a first fixing portion to fix the controlling member so as to keep the charging roller spaced apart from the photosensitive body, and a second fixing portion to restrict a contact position between the charging roller and the photosensitive body.

The controlling member may include a first holder that is elastically deformable so as to be releasably caught by the first fixing portion, and a second holder to be caught and supported by the second fixing portion when the first holder is released and moved from the first fixing portion.

The first holder may be pressed by a rod release unit provided at the body when the developing unit is mounted in the body, thereby being released from the first fixing portion.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION

Figure 1:
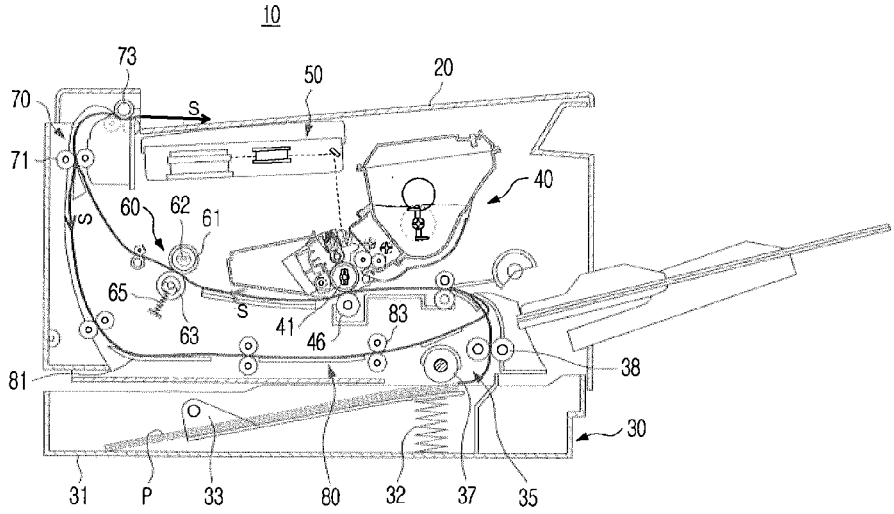
FIG. 1 is a sectional view illustrating a configuration of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
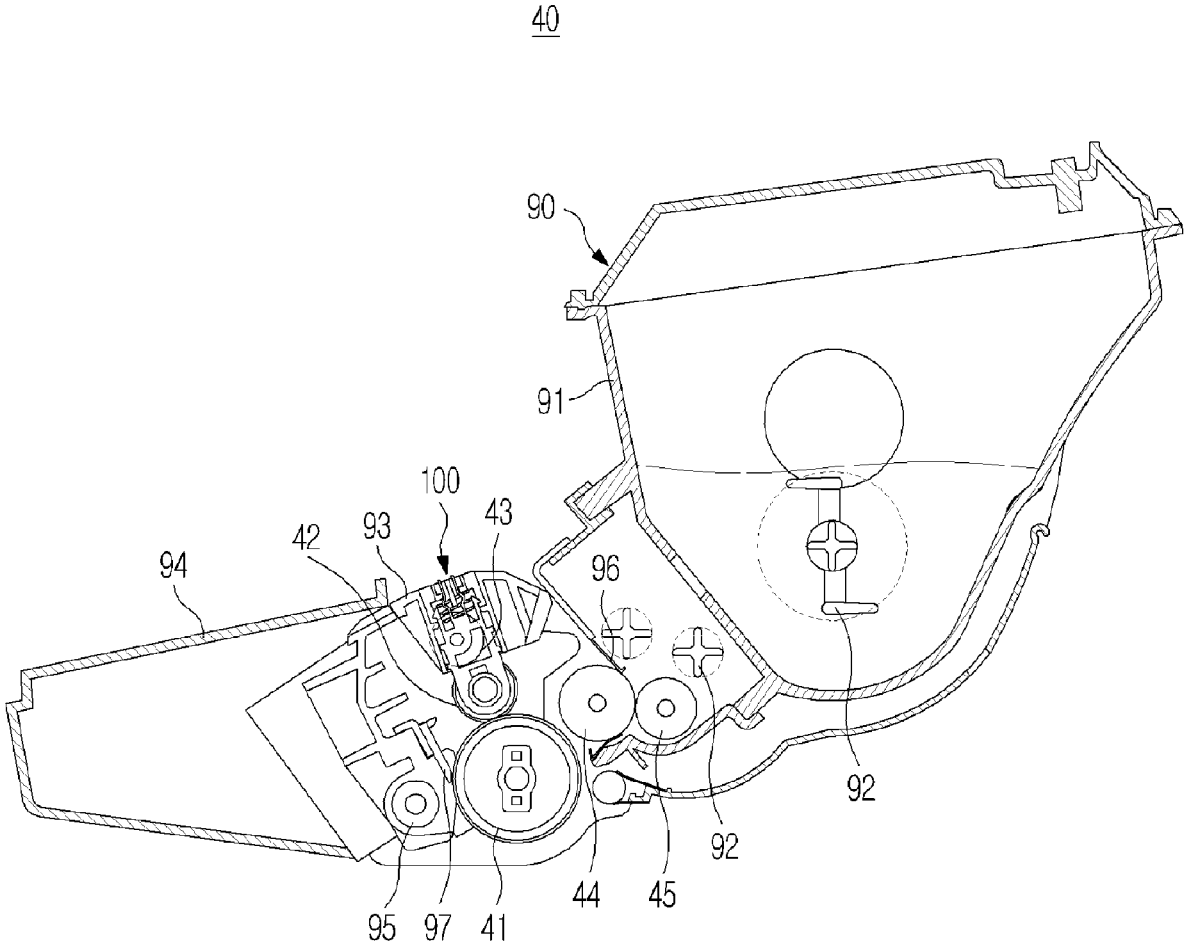
FIG. 2 is a sectional view illustrating a configuration of a developing unit usable with the image forming apparatus according to an exemplary embodiment of the present general inventive concept.

FIG. 1 is a sectional view illustrating a configuration of an image forming apparatus according to an exemplary embodiment of the present general inventive concept FIG. 2 is a sectional view illustrating a configuration of a developing unit usable with the image forming apparatus according to an exemplary embodiment of the present general inventive concept.

As shown in FIG. 1, the image forming apparatus 10 according to an exemplary embodiment of the present general inventive concept includes a body 20 defining an exterior appearance of the image forming apparatus 10, a paper supply unit 30 to store and supply a printing medium P, a developing unit 40 to form an image on the printing medium P supplied via the paper supply unit 30, a light scanning unit 50 to form an electrostatic latent image on a photosensitive body 41 of the developing unit 40, a fusing unit 60 to fuse an image, which has been transferred to the printing medium P, to the printing medium P, a paper discharge unit 70 to discharge the printing medium P, on which the image has been completely formed, out of the body 20, and a double-sided printing unit 80 to return the printing medium P, on a surface of which the image has been completely formed, to the developing unit 40.

The paper supply unit 30 serves to store and supply the printing medium P and is arranged in a lower region of the body 20 to supply the printing medium P toward the developing unit 40.

The paper supply unit 30 may include a paper supply tray 31 in the form of a cassette. The paper supply tray 31 may be pushed into and/or pulled out of the body 20 to store the printing medium P, and a delivery unit 35 to pick up the printing medium P stored in the paper supply tray 31 sheet by sheet so as to transmit the printing medium P toward the developing unit 40.

A knock-up plate 33 may be arranged in the paper supply tray 31 to guide the printing medium P loaded thereon toward the delivery unit 35. One end of the knock-up plate 33 may be rotatably coupled to the bottom of the knock-up plate 33 and the other end of the knock-up plate 33 may be supported on a pressure spring 32.

The delivery unit 35 includes a pickup member 37 to pick up the printing medium P loaded on the knock-up plate 33 sheet by sheet, and a roller-shaped feed member 38 to deliver the printing medium P picked up by the pickup member 37 toward the developing unit 40.

The light scanning unit 50 serves to form an electrostatic latent image on the photosensitive body 41 by irradiating light containing image information to the photosensitive body 41. The photosensitive body 41 may be exposed to an outside of the housing 90 through a lower opening 98 to transfer an image formed thereon to a print medium (P).

The fusing unit 60 serves to fuse a developer image, which has been formed on the printing medium P, to the printing medium P by applying heat and pressure to the printing medium P.

The fusing unit 60 includes a heating member 61 provided with a heating source 62, and a press roller 63 to press the printing medium P toward the heating member 61.

The heating source 62 may include, but is not limited to, a heat-emitting body to heat the heating member 61, such as a heater, heat-emitting lamp, hot wire, etc.

The heating member 61 may include, but is not limited to, a roller in which the heating source 62 is installed, and a belt to be heated by the heating source 62.

The press roller 63 is supported by an elastic member 65, so that a predetermine fusing pressure is kept between the press roller 63 and the heating member 61 which come into close contact with each other. Additionally, a plurality of press rollers 63 may be provided.

Accordingly, as the fusing unit 60 applies heat and pressure to a visible image transferred to the printing medium P when the printing medium P passes through between the heating member 61 and the press roller 63, the visible image is fused to the printing medium P.

The paper discharge unit 70 includes a first discharge roller 71 and a second discharge roller 73 arranged in sequence, and serves to discharge the printing medium P, having passed through the fusing unit 60, out of the body 20.

The double-sided printing unit 80 serves to return the printing medium P, on a surface of which the image has been completely formed, to the developing unit 40, so as to enable printing of both surfaces of the printing medium P.

The double-sided printing unit 80 includes a double-sided printing guide 81 to define a return path of the printing medium P, and return rollers 83 installed on the return path of the printing medium P to deliver the printing medium P.

To perform a double-sided printing operation, the printing medium P having one surface of which an image has been completely formed is inverted at a predetermined time while moving the printing medium P by the second discharge roller 73. The inverted printing medium P is guided to the double-sided printing guide 81 and is returned to the developing unit 40 by the return rollers 83. As the returned printing medium P sequentially passes through the developing unit 40 and the fusing unit 60, another image is formed on the other surface of the printing medium P.

The developing unit 40 is located on a printing path S above the paper supply unit 30 and forms a developer image on the printing medium P delivered from the paper supply unit 30.

The developing unit 40, as shown in FIG. 2, may include a housing 90 defining an exterior appearance of the developing unit 40. In addition to the photosensitive body 41, other main elements required to develop an image, such as a charging roller 42, a cleaning roller 43, a developing roller 44, a supply roller 45, etc., may be received in the housing 90. Accordingly, the housing 90 may take the form of a single process cartridge.

The housing 90 may be divided into a developing part 93, a developer supply part 91, and a waste developer storage part 94. The developing part 93 receives processing members to form an image and transfer the image onto the printing medium P, the developer supply part 91 supplies developer to the developing part 93, and the waste developer storage part 94 stores waste developer collected from the developing part 93.

The developer supply part 91 may receive rotating members 92, which serve not only to agitate developer stored in the developer supply part 91, but also to supply the developer to the developing part 93.

The developer supply part 91 may be integrated with or detachably coupled to the developing part 93 of the housing 90.

The developing part 93 may receive the photosensitive body 41 on which an electrostatic latent image is formed, the charging roller 42 to charge the photosensitive body 41 with a predetermined electric potential, the cleaning roller 43 to remove contaminants attached to a surface of the charging roller 42, the developing roller 44 to develop the electrostatic latent image formed on the photosensitive body 41 into a developer image with the developer, and the supply roller 45 to supply the developer from the developer supply part 91 to the developing roller 44.

The photosensitive body 41 may serve as an image carrier containing a developer image and may have a drum shape.

As the light scanning unit 50 irradiates light to the photosensitive body 41 according to image information using, for example, a laser beam, an electrostatic latent image is formed on a surface of the photosensitive body 41.

The charging roller 42 charges the surface of the photosensitive body 41 with a predetermined electric potential while being rotated in contact with the surface of the photosensitive body 41.

The developing roller 44 develops the electrostatic latent image formed on the photosensitive body 41 into a developer image by supplying the developer to the photosensitive body 41.

The developing roller 44 may supply the developer to the photosensitive body 41 in a contact or non-contact manner.

The supply roller 45 supplies the developer stored in the developer supply part 91 to the developing roller 44.

The developer supplied to the developing roller 44 may define a constant thickness of developer layer via operation of a regulating member 96.

Accordingly, after the light scanning unit 50 forms an electrostatic latent image on the surface of the photosensitive body 41 which has been charged with a predetermined electric potential by the charging roller 42, the developer stored in the developer supply part 91 may be supplied to the electrostatic latent image via the supply roller 45 and the developing roller 44, developing the electrostatic latent image into a developer image. In this way, a visible image made of developer powder is formed on the photosensitive body 41.

A transfer roller 46, as shown in FIG. 1, may be installed in the body 20 to transfer the visible image formed on the photosensitive body 41 to a surface of the printing medium P by pressing the printing medium P toward the photosensitive body 41.

The transfer roller 46 may be located to come into contact with the photosensitive body 41 of the developing unit 40 when the developing unit 40 is mounted in the body 20.

Accordingly, as the printing medium P passes through between the photosensitive body 41 and the transfer roller 46, the visible image of the photosensitive body 41 is transferred to the printing medium P by a developing nip.

The waste developer storage part 94 may receive a rotating member 95 to agitate or deliver the developer that has been removed from the photosensitive body 41 by a cleaning blade 97 and collected from the developing part 93.

The waste developer storage part 94 may be integrated with or detachably coupled to the developing part 93 of the housing 90.

Figure 3:
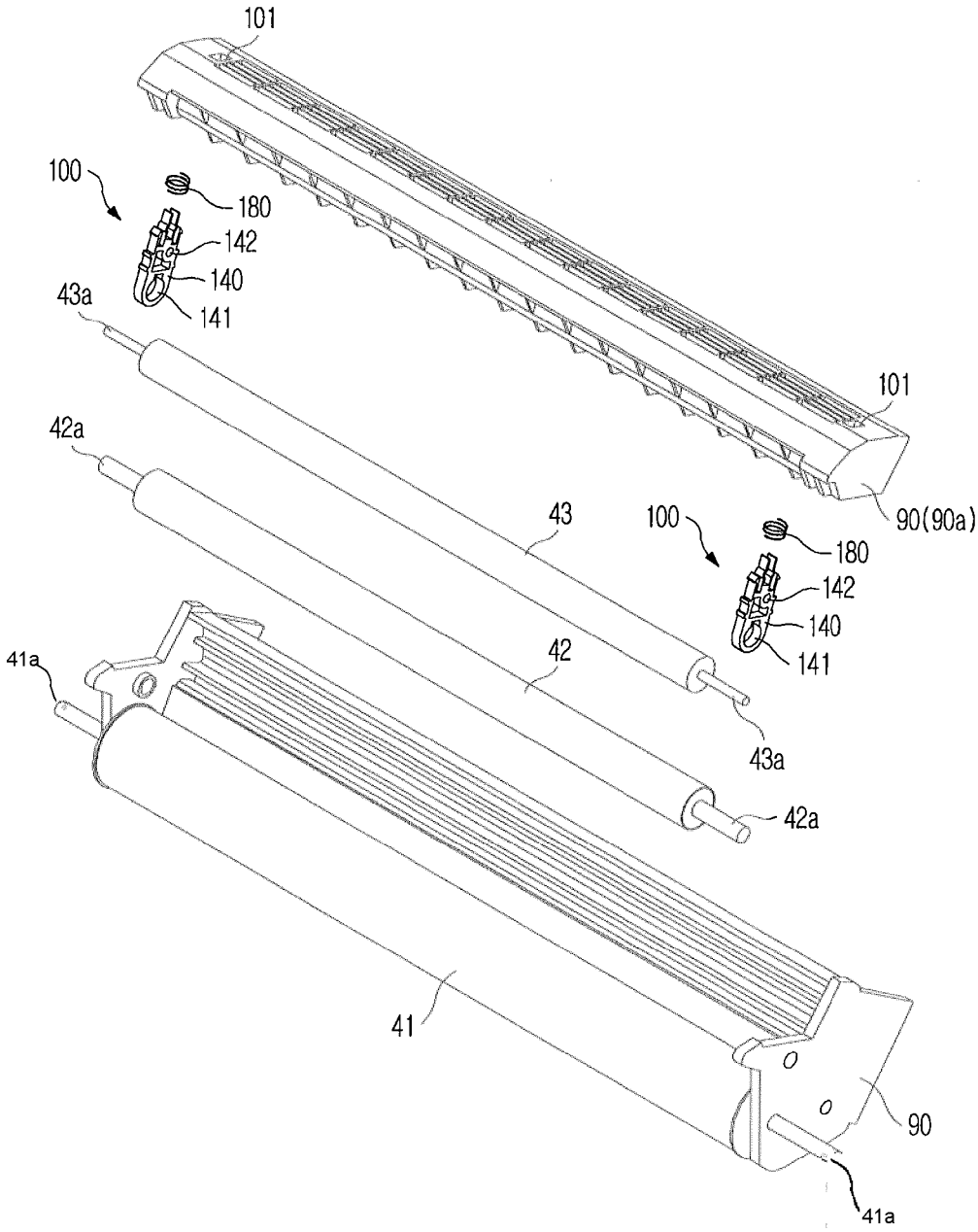
FIG. 3 is an exploded perspective view illustrating a developing part of the developing unit according to an exemplary embodiment of the present general inventive concept.
Figure 4:
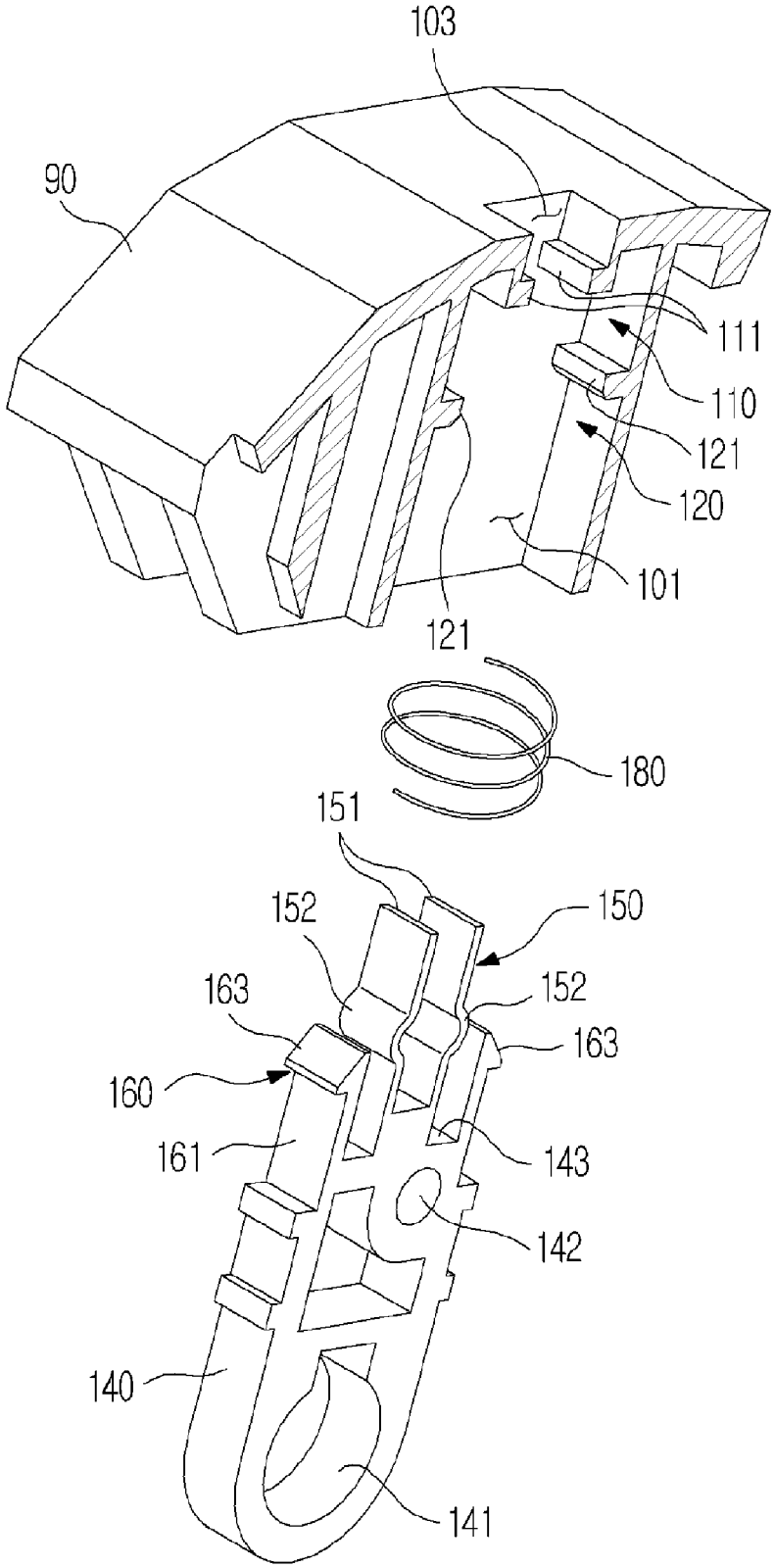
FIG. 4 is a perspective view illustrating a controlling unit usable with the developing unit according to an exemplary embodiment of the present general inventive concept.
Figure 5:
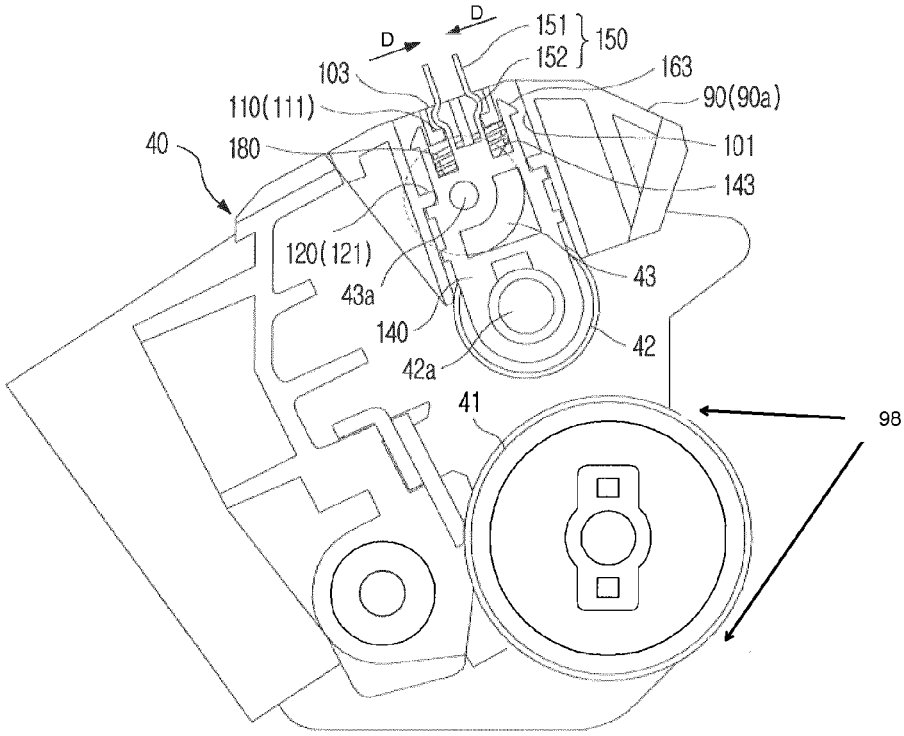
FIG. 5 is a sectional view illustrating a state in which the controlling unit is mounted in the developing unit according to an exemplary embodiment of the present general inventive concept.
Figure 6:
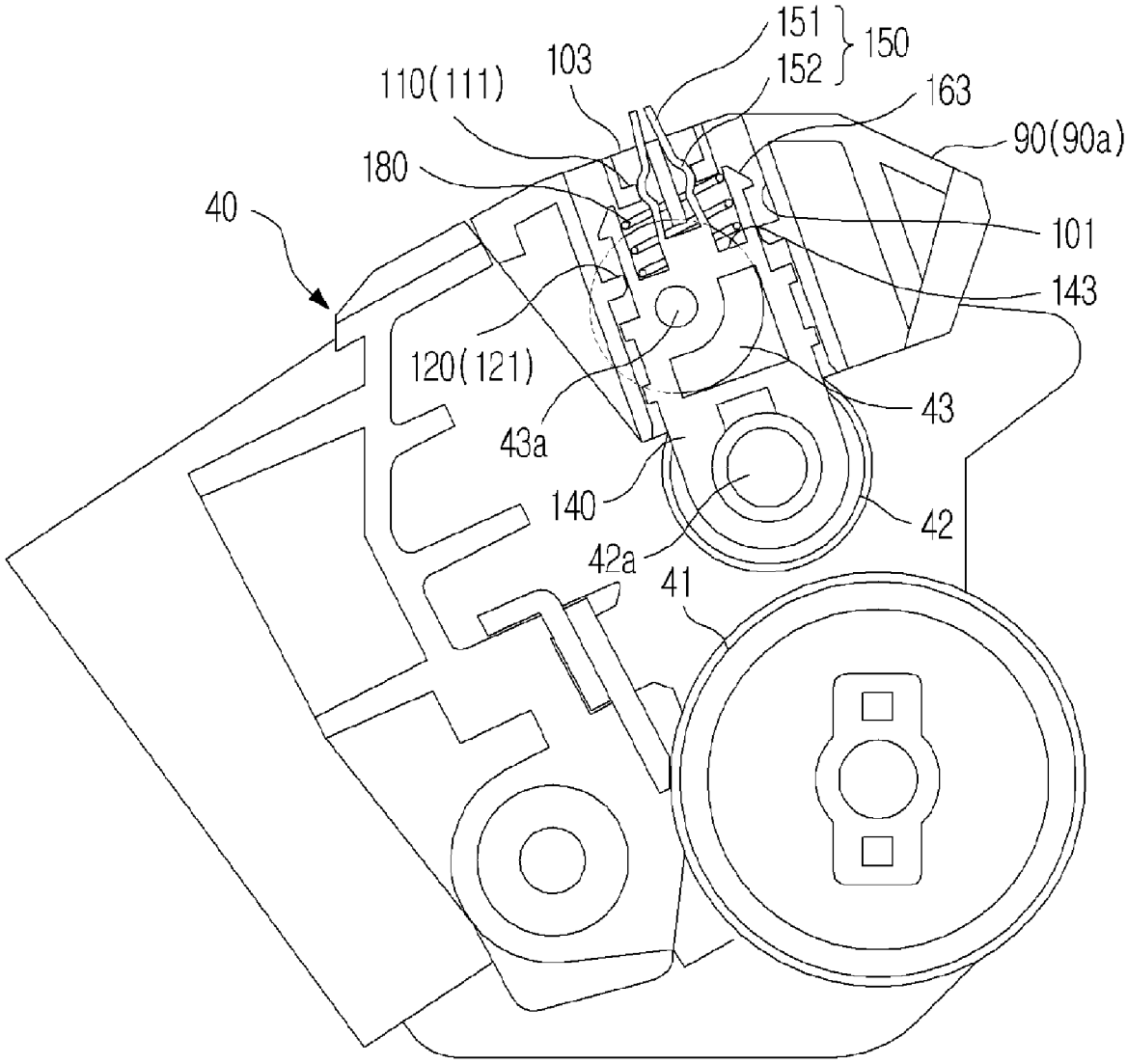
FIG. 6 is a sectional view illustrating operation of the controlling unit mounted in the developing unit according to an exemplary embodiment of the present general inventive concept.

FIG. 3 is an exploded perspective view illustrating the developing part of the developing unit according to an exemplary embodiment of the present general inventive concept. FIG. 4 is a perspective view illustrating a controlling unit usable with the developing unit according to an exemplary embodiment of the present general inventive concept. FIG. 5 is a sectional view illustrating a state in which the controlling unit is mounted in the developing unit according to an exemplary embodiment of the present general inventive concept. FIG. 6 is a sectional view illustrating operation of the controlling unit mounted in the developing unit according to an exemplary embodiment of the present general inventive concept.

As shown in FIG. 3, both ends 41*a* of the photosensitive body 41 are rotatably supported by portions of the housing 90 of the developing unit 40. The charging roller 42, which electrically charges the photosensitive body 41 while being rotated in electrical contact with the photosensitive body 41, may be movable in the housing 90 while being coupled to a controlling unit 100. Electrical contact includes, but is not limited to, static-electro force, frictional force, etc.

The controlling unit 100 serves to restrict contact between the charging roller 42 and the photosensitive body 41. The controlling unit 100 maintains a predetermined distance between the charging roller 42 and the photosensitive body 41 before the developing unit 40 is mounted in the body 20. Therefore, the controlling unit may allow the charging roller 42 and the photosensitive body 41 to come into contact with each other after the developing unit 40 is mounted in the body 20.

By virtue of the controlling unit 100 to keep the charging roller 42 at a position spaced apart from the photosensitive body 41 at an initial manufacture stage of the developing unit 40, there exists no contact nip between the charging roller 42 and the photosensitive body 41 even if the developing unit 40 is not used for a long period of time prior to being mounted in the body 20 and it may be possible to prevent surface deformation of the charging roller 42 having relatively low rigidity. The initial manufacturer state may include a stage where developer unit 40 is assembled as a cartridge such that the charging roller 42 is placed in a first position away from the photosensitive body 41, but is not inserted into the image forming apparatus 10, e.g., as shown in FIG. 5. Alternatively, the initial manufacturer state may be a state where the developing unit is not in an operating state.

The controlling unit 100 may include a controlling member 140 and an elastic member 180. One end of the controlling member 140 is coupled to a rotating shaft 42*a* provided at least one end of the charging roller 42 and the other end of the controlling member 140 is movably coupled to a controlling member mount 101 formed at the housing 90. The controlling member 140 may include grooves 143 to receive the elastic member 180. The elastic member 180 elastically supports the controlling member 140 to push the controlling member 140 toward the photosensitive body 41.

The controlling member 140 has an approximately rectangular plate shape and may be formed with a charging roller seating recess 141 into which the rotating shaft 42*a* of the charging roller 42 is seated.

In addition, the controlling member 140 may be formed with a cleaning roller seating recess 142 into which a rotating shaft 43*a* of the cleaning roller 43 is seated. The cleaning roller 43 is located above the charging roller 42 so as to come into contact with the charging roller 42.

The controlling member mount 101 may be formed at an upper lateral side of the housing 90 of the developing unit 40. In one example, as shown in FIG. 3, the controlling member mount 101 may be formed at a separate supporting member 90*a* that is detachably coupled to the housing 90.

Referring to FIG. 4, the controlling member mount 101 may take the form of a recess. One side of which communicates with the interior of the housing 90 and the other side communicates with the exterior of the housing 90, allowing the controlling member 140 to be received in the controlling member mount 101.

Once inserted into the controlling member mount 101, the controlling member 140 may be kept stationary in the controlling member mount 101 so long as no predetermined external force is applied to the controlling member 140. However, when the predetermined external force is applied, the controlling member 140 may move in the controlling member mount 101 to cause the photosensitive body 41 and the charging roller 42 to come into contact with each other.

The controlling member mount 101 may include a first fixing portion 110 that generates a first force to restrict movement of the controlling member 140 so that the charging roller 42 supported on the controlling member 140 is kept spaced apart from the photosensitive body 41. The controlling member 140 may have a first holder 150 to be releasably caught by the first fixing portion 110.

The first holder 150 shown in FIG. 4 may be elastically deformable, so as to be released from the first fixing portion 110 upon receiving external force.

The first holder 150 may include a pair of elastic rods 151 and holding protrusions 152. The elastic rods 151 are arranged opposite each other to define an elastically deformable plug and extend upward from the center of an upper end of the controlling member 140. The holding protrusions 152 protrude outward from the center of the respective elastic rods 151, so as to be caught and supported by the first fixing portion 110.

The first fixing portion 110 may include holding ribs 111, which extend inward from opposite sides of a lower end of the top opening 103 formed in the top of the controlling member mount 101.

Accordingly, as shown in FIG. 5, the holding protrusions 152 of the elastic rods 151 are caught and supported by the holding ribs 111 when the elastic rods 151 are introduced into a gap between the holding ribs 111. Accordingly, movement of the controlling member 140 may be restricted.

In a state wherein the holding protrusions 152 are supported by the holding ribs 111, ends of the elastic rods 151 may protrude upward from the top opening 103 of the controlling member mount 101.

Accordingly, it may be possible to apply external force to the elastic rods 151 protruding from the opening 103. When external force is applied to push the elastic rods 151 toward each other, the holding protrusions 152 of the elastic rods 151 may be released from the holding ribs 111.

Once the controlling member 140 is released from the controlling member mount 101, the controlling member 140 is pushed and moved toward the photosensitive member 41 by elasticity of the elastic member 180.

The elastic member 180 may be a compressive coil spring, one end of which is supported by the first fixing portion 110 and the other end of which is supported by an elastic member mount defined in the controlling member 140.

Referring to FIG. 4, the controlling member mount 101 may include a second fixing portion 120 to restrict movement of the controlling member 140 so as to restrict a contact position between the charging roller 42 and the photosensitive body 41 when the controlling member 140 is moved by elasticity of the elastic member 180. The controlling member 140 may have a second holder 160 to be caught and supported by the second fixing portion 120.

The second fixing portion 120 may include holding ribs 121 protruding inward from opposite sidewalls of the controlling member mount 101 at positions under the first fixing portion 110.

The second holder 160 may include a pair of bars 161 extending upward from opposite sides of an upper surface of the controlling member 140 so as to be caught and supported by the holding ribs 121. Holding hooks 163 may be provided at distal ends of the respective bars 161.

Accordingly, even if the charging roller 42 coupled to the controlling member 140 is moved toward the photosensitive body 41 by elasticity of the elastic member 180 as the first holder 150 of the controlling member 140 is released from the first fixing portion 110 of the controlling member mount 101, deformation of the charging roller 42 due to collision between the charging roller 42 and the photosensitive body 41 does not occur.

Hereinafter, operation of the controlling unit 110 provided in the developing unit according to the embodiment of the present general inventive concept will be described.

As shown in FIG. 5, when the controlling member 140 is initially inserted i.e., inserted during a non-operative state, or a state where the charging roller 42 does not contact the photosensitive body 41, into the controlling member mount 101 formed in the housing 90 of the developing unit 40, the controlling member 140 is elastically supported to be pushed toward the photosensitive body 41 by the elastic member 180.

In addition, the first holder 150 of the controlling member 140 is caught and supported by the first fixing portion 110 of the controlling member mount 101. Accordingly, movement of the controlling member 140 in the controlling member mount 101 is restricted.

In a state wherein the controlling member 140 is kept stationary and is restricted in movement by the first fixing portion 110, the charging roller 42 coupled to the controlling member 140 is kept spaced apart from the photosensitive body 41.

Accordingly, since the photosensitive body 41 and the charging roller 42 may be stored without a contact nip therebetween prior to mounting the developing unit 40 into the body 20, it may be possible to prevent surface deformation of the charging roller 42. Conventionally, a charging roller has defined a contact nip with a photosensitive body and thus, has suffered from surface deformation when the developing unit is not used for a long period of time.

On the other hand, in a state wherein the developing unit 40 is manually mounted in the body 20 of the image forming apparatus 10, when the elastic rods 151 of the first holder 150 partially protruding from the opening 103 are forced by a second force that may be greater than the first force of fixing unit 110, and may be pushed toward each other in a direction designated by the arrows D, as shown in FIG. 6, the first holder 150 is elastically deformed to be released from the first fixing portion 110 and the controlling member 140 is moved by elasticity of the elastic member 180, allowing the charging roller 42 to be moved so as to come into contact with the photosensitive body 41.

In this case, although the charging roller 42 may have surface deformation due to collision with the photosensitive body 41 by elasticity of the elastic member 180, the second holder 160 of the controlling member 140 is caught and is restricted in movement by the second fixing portion 120 that serves to restrict a contact position between the charging roller 42 and the photosensitive body 41 to alleviate an impact force.

Once the charging roller 42 is brought into contact with the photosensitive body 41 via movement of the controlling member 140, the charging roller 42 acts to electrically charge the photosensitive body 41 via frictional rotation thereof while being elastically supported by the elastic member 180 to apply a constant pressure to the photosensitive body 41.

The body 20 may be formed with a release unit 21, which serves to release the first holder 150 of the controlling member 140 from the first fixing portion 110 by applying a predetermined external force to the first holder 150. The predetermined external force may be applied by a user of the developer unit 40 after manually manipulating the elastic rods 151 of FIGS. 4-6.

It may also be appreciated that the predetermined external force may be applied by an inner portion of the body 20 when the developing unit 40 is mounted in the image forming apparatus 10. That is, the inner portion of the body 20 may include a portion that contacts the elastic rods 151 or the clamp members 113 after the developing unit is mounted.

Figure 10:
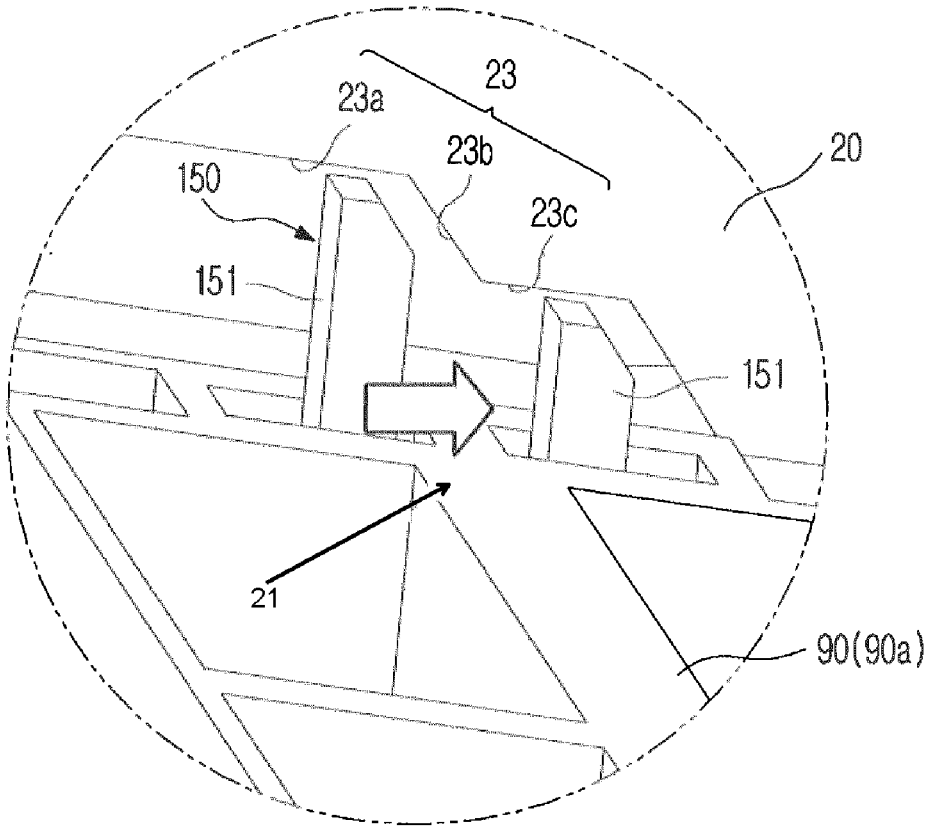
FIG. 10 is a view illustrating an operation to mount the developing unit in the image forming apparatus according to an exemplary embodiment of the present general inventive concept.

As shown in FIG. 10, the release unit 21 may include a rod guide 23 formed at a region of the body 20 where the developing unit 40 will be mounted. The rod guide 23 serves to press the elastic rods 151 of the first holder 150 partially protruding from the top opening 103 of the housing 90 of the developing unit 40, allowing the controlling member 140 to be movable in the controlling member mount 101.

The rod guide 23 consists of an entrance portion 23*a* to guide entrance of the elastic rods 151, a press portion 23*b* obliquely extending downward from a distal end of the entrance portion 23*a* to press the elastic rods 151, and a supporting portion 23*c* extending horizontally from a distal end of the press portion 23*b* to support the elastic rods 151 that have been released by the press portion 23*b*.

When the developing unit 40 is mounted in the body 20, the elastic rods 151 are moved from the entrance portion 23*a* to the press portion 23*b*. As the press portion 23*b* presses the ends of the elastic rods 151 passing therethrough, the holding protrusions 152 of the elastic rods 151 are released from the first fixing portion 110.

Thereafter, when the elastic rods 151 pass through the supporting portion 23*c* and the developing unit 40 is completely mounted in the body 20, the controlling member 140 is moved in the controlling member mount 101, allowing the charging roller 42 to come into contact with the photosensitive body 41.

Figure 7:
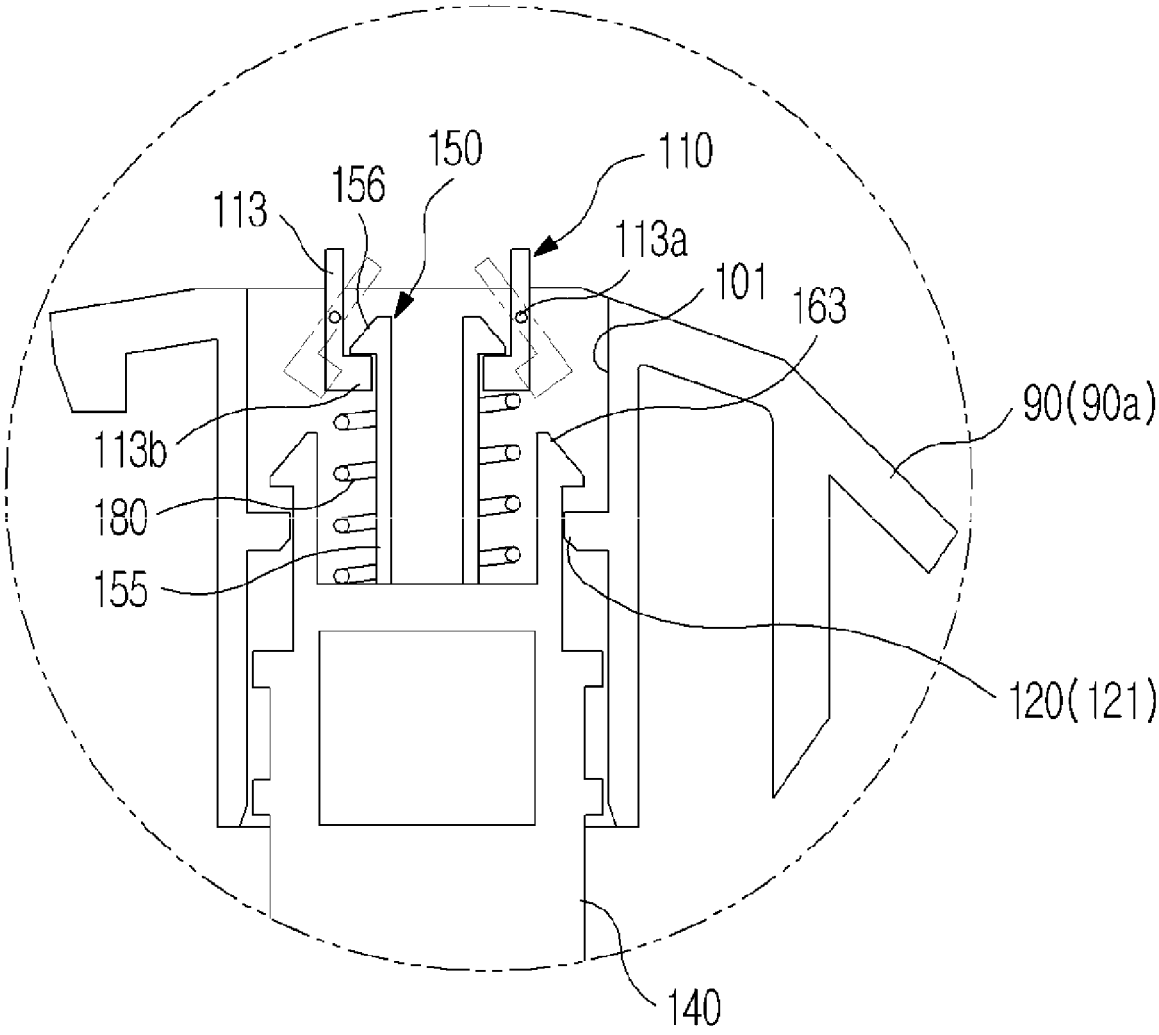
FIGS. 7 and 8 are views illustrating alternative holding configurations of a controlling member of the developing unit according to another exemplary embodiment of the present general inventive concept.
Figure 8:
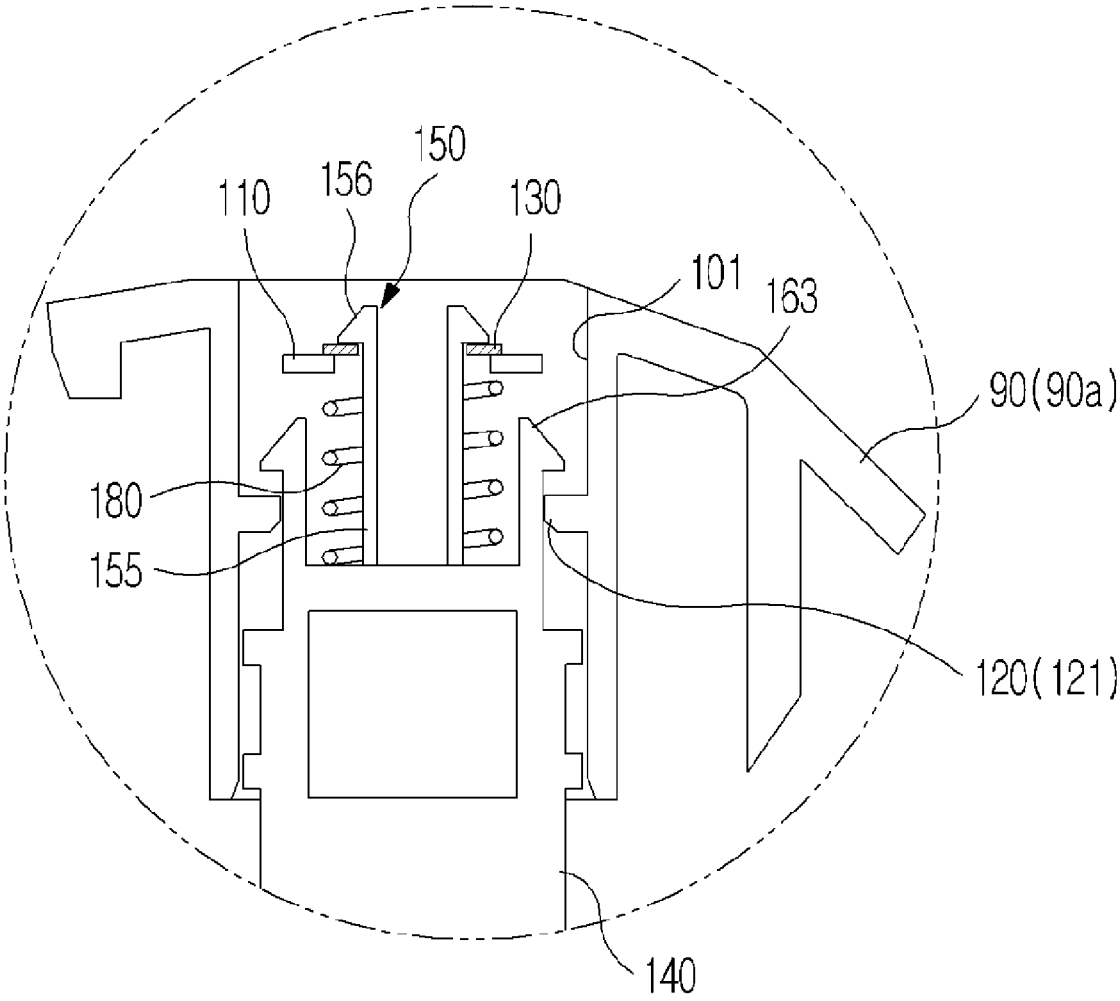

FIGS. 7 and 8 are views illustrating alternative holding configurations of the controlling member of the developing unit according to an exemplary embodiment of the present general inventive concept.

Although FIG. 4 illustrates a holding configuration of the controlling member 140 coupled to the developing unit 40 wherein the first holder 150 is elastically deformable so as to be caught by and/or released from the first fixing portion 110, as shown in FIG. 7, the first fixing portion 110 may take the form of a clamp by which the first holder 150 is releasably clamped.

More specifically, the first holder 150 shown in FIG. 7 may include a pair of rods 155 arranged opposite each other to extend upward from the center of the upper surface of the controlling member 140, and holding protrusions 156 provided at distal ends of the respective rods 155. The first fixing portion 110 may include a pair of clamp members 113 each of which is rotatable about a rotating shaft 113*a* and has a supporting portion 113*b* by which the corresponding holding protrusion 156 is caught and supported.

Accordingly, when external force is applied to upper ends of the clamp members 113 to push the clamp members 113 toward each other, the clamp members 113 are rotated about the rotating shafts 113*a*, causing the holding protrusions 156 to be released from the supporting portions 113*b* and consequently, allowing the controlling member 140 to be moved in the controlling member mount 101 by elasticity of the elastic member 180.

Referring to FIG. 8, a stopper member 130 may be detachably provided between the first fixing portion 110 and the first holder 150, to restrict movement of the controlling member 140.

In this case, the first holder 150 may include the rods 155 arranged opposite each other to extend upward from the center of the upper surface of the controlling member 140, and the holding protrusions 156 provided at distal ends of the respective rods 155 so as to be indirectly caught by the first fixing portion 110 of the housing 90.

The stopper member 130 may have an approximately washer shape and may be interposed between the first fixing portion 110 and the holding protrusions 156 so that a lower surface of the stopper member 130 is seated on the first fixing portion 110 and the holding protrusions 156 are seated on an upper surface of the stopper member 130.

Accordingly, when the stopper member 130 is separated from between the first fixing portion 110 and the holding protrusions 156, the holding protrusions 156 are released from the first fixing portion 110, allowing the controlling member 140 to be moved in the controlling member mount 101 by elasticity of the elastic member 180.

Figure 9A:
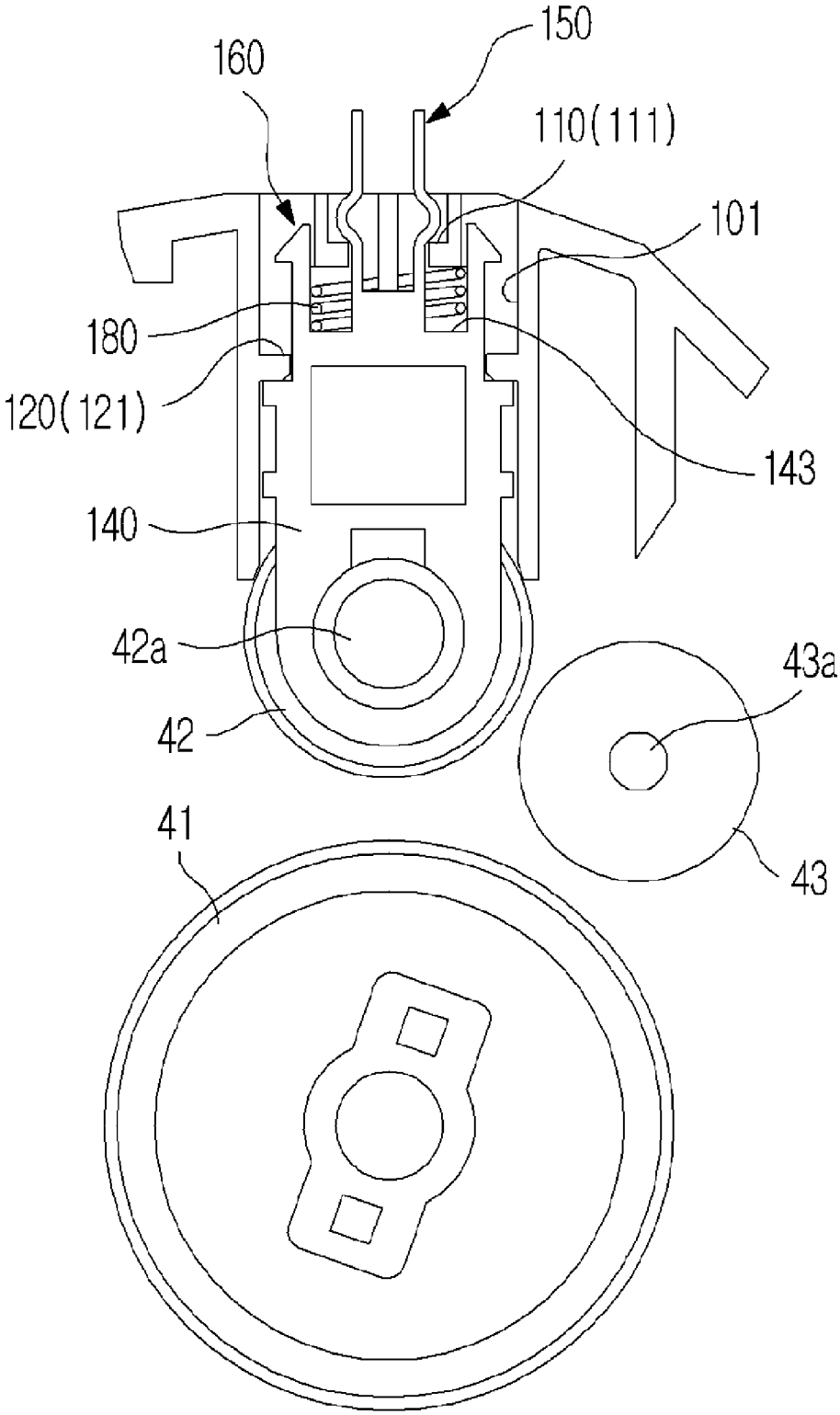
FIGS. 9A and 9B are views illustrating a developing unit according to another exemplary embodiment of the present general inventive concept.
Figure 9B:
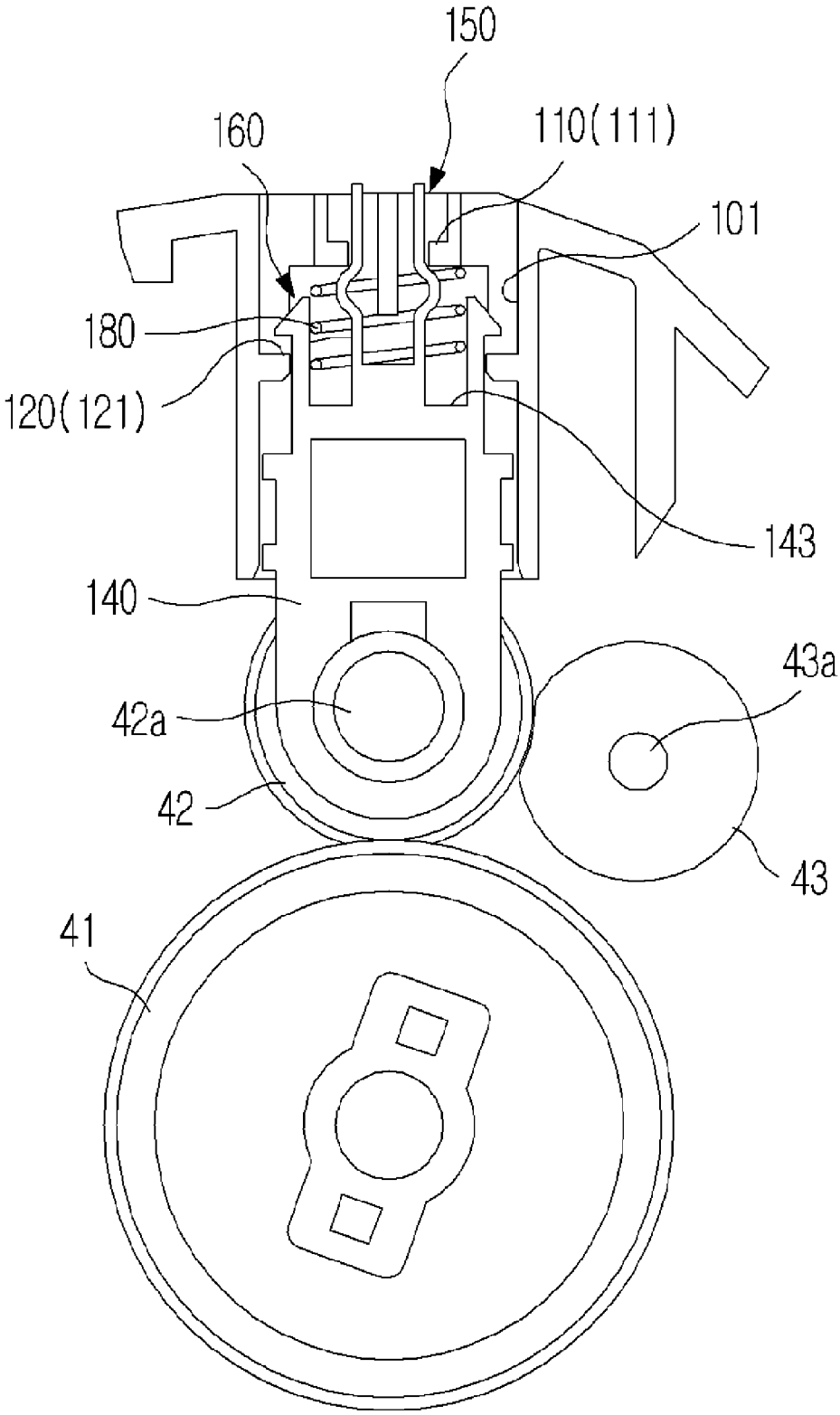

FIGS. 9A and 9B are views illustrating a developing unit according to another embodiment of the present general inventive concept. Hereinafter, constituent elements having a similar function as those of the previously described embodiment will be designated by the same reference numerals.

Referring to FIGS. 9A and 9B, the controlling member 140, which is mounted in the controlling member mount 101 of the housing 90, is coupled to the charging roller 42, and the cleaning roller 43 to clean the charging roller 42 may be rotatably coupled to the housing 90 of the developing unit 40.

Although FIG. 5 illustrates the charging roller 42 and the cleaning roller 43 as being arranged above and below the controlling member 140 to come into contact with the controlling member 140, this arrangement may cause surface deformation of the cleaning roller 43 having relatively low rigidity. Therefore, at least one exemplary embodiment provides the cleaning roller 43 coupled to the housing 90.

The cleaning roller 43 may be located to come into contact with the charging roller 42 when the charging roller 42 comes into contact with the photosensitive member 41 via movement of the controlling member 140 coupled thereto.

More specifically, as shown in FIG. 9A, the photosensitive body 41 and the cleaning roller 43 are rotatably coupled to the housing 90 of the developing unit 40 while being spaced apart from each other. The charging roller 42 coupled to the controlling member 140 is spaced apart from the photosensitive body 41 and the cleaning roller 43.

With this arrangement, surface deformation may be prevented since there exists no contact nip between the photosensitive body 41, the charging roller 42, and the cleaning roller 43, even if the developing unit 40 has a long storage term prior to being mounted in the body 20.

Then, when the controlling member 140 is released from the first fixing portion 110 in a state where the developing unit 40 is mounted in the body 20, as shown in FIG. 9B, the controlling member 140 is moved from the controlling member mount 101 toward the photosensitive body 41 by elasticity of the elastic member 180.

Accordingly, the charging roller 42 coupled to the controlling member 140 may be brought into contact with the photosensitive body 41 and the cleaning roller 43, causing creation of respective contact nips.

As is apparent from the above description, in a developing unit according to the embodiment of the present general inventive concept, a charging roller may be spaced apart from a photosensitive body prior to mounting the developing unit into a body of an image forming apparatus. This may prevent deformation of the charging roller despite long-term storage of the developing unit.

Although a few exemplary embodiments of the present general inventive concept have been shown and described, it would be appreciated by those skilled in the art that changes may be made in these exemplary embodiments without departing from the principles and spirit of the general inventive concept, the scope of which is defined in the claims and their equivalents.

What is claimed is:

1. A developing unit comprising:

a housing including a first fixing portion;

a photosensitive body arranged in the housing;

a roller arranged in the housing to come into contact with the photosensitive body; and a controlling unit installed in the housing, and including a controlling member to seat and support the roller and to keep the roller at a first position spaced apart from the photosensitive body based on the first fixing portion, and including an elastic member to elastically support and push the controlling member toward the photosensitive body such that when a predetermined external force is applied to the controlling unit, the roller moves to a second position to allow the roller to come into contact with the photosensitive body.

2. The developing unit according to claim 1, wherein:

the roller includes a charging roller to electrically charge the photosensitive body; and.

3. The developing unit according to claim 2, wherein the controlling unit is coupled to a supporting member that is at least one of attachable to and detachable from the housing.

4. The developing unit according to claim 2, wherein the housing includes a controlling member mount to receive the controlling member, and the controlling member is slidable in the controlling member mount while supporting both ends of the charging roller.

5. The developing unit according to claim 4, wherein one side of the controlling member mount communicates with the interior of the housing and the other side of the controlling member communicates with the exterior of the housing.

6. The developing unit according to claim 5, wherein the controlling member mount includes a first fixing portion to keep the charging roller spaced apart from the photosensitive body and a second fixing portion to restrict a contact position between the charging roller and the photosensitive body.

7. The developing unit according to claim 6, wherein the controlling member includes a first holder to be caught by the first fixing portion in response to being released and a second holder to be caught by the second fixing portion in response to being released.

8. The developing unit according to claim 6, wherein the first holder includes an elastic rod partially protruding through an opening that communicates with the exterior of the housing to be released from the first fixing portion via elastic deformation thereof, and the elastic rod having a holding protrusion supported by the first fixing portion.

9. The developing unit according to claim 8, wherein the elastic rod protruding through the opening is pressed and deformed by a rod release unit provided at the body when the developing unit is mounted in the body.

10. The developing unit according to claim 2, wherein a cleaning roller to clean the charging roller is rotatably coupled to the controlling member.

11. The developing unit according to claim 2, further comprising a cleaning roller spaced apart from the photosensitive body within the housing, wherein the cleaning roller is positioned to come into contact with the charging roller when the charging roller comes into contact with the photosensitive body.

12. The developing unit according to claim 1, wherein the controlling member includes a first holder to be caught by the first fixing portion in response to being released.

13. The developing unit according to claim 12, wherein the first holder is elastically deformable to be released from the first fixing portion.

14. The developing unit according to claim 13, wherein the first holder includes elastic rods extending opposite each other from one side of the controlling member to be elastically deformable, and holding protrusions formed at the elastic rods to be caught and supported by the first fixing portion.

15. The developing unit according to claim 12, further comprising a stopper member detachably provided between the first fixing portion and the first holder to allow the first holder to be caught by the first fixing portion in response to being released.

16. The developing unit according to claim 12, wherein the first fixing portion includes a clamp member to catch the first holder in response to the first holder being released.

17. The developing unit according to claim 16, wherein the first holder includes a holding protrusion formed at one side of the controlling member, and the clamp member is rotatable about a rotating shaft and has a supporting portion to catch and support the holding protrusion.

18. The developing unit according to claim 1, wherein the housing includes a second fixing portion to restrict movement of the controlling member to restrict a contact position between the charging roller and the photosensitive body when the controlling member is moved.

19. The developing unit according to claim 18, wherein the controlling member includes a second holder to be caught and supported by the second fixing portion.

20. An image forming apparatus having a developing unit detachably installed in a body to form an image on a printing medium supplied via a paper supply unit, the developing unit comprising:

a housing and a photosensitive body arranged in the body to be electrically charged by a charging roller; and a controlling unit received by the housing to restrict contact between the charging roller and the photosensitive body, and including a controlling member to seat and support the charging roller and an elastic member to elastically support and push the controlling member toward the photosensitive body, and including a controlling member mount to movably support the controlling member, the controlling member mount including a first fixing portion to fix the controlling member to position the charging roller apart from the photosensitive body and a second fixing portion to restrict a contact position between the charging roller and the photosensitive body.

21. The image forming apparatus according to claim 20, wherein the controlling member includes a first holder that is elastically deformable to be caught by the first fixing portion in response to being released, and a second holder to be caught and supported by the second fixing portion when the first holder is released and moved from the first fixing portion.

22. The image forming apparatus according to claim 21, wherein the first holder is pressed by a rod release unit provided at the body when the developing unit is mounted in the body, thereby being released from the first fixing portion.

* * * * *